US008561923B2

(12) United States Patent
Staedtler

(10) Patent No.: US 8,561,923 B2
(45) Date of Patent: Oct. 22, 2013

(54) JET REGULATOR

(75) Inventor: Georg Staedtler, Bad Rodach/Gauerstadt (DE)

(73) Assignee: Neoperl GmbH, Muellheim (DE)

( * ) Notice: Subject to any disclaimer, the term of this patent is extended or adjusted under 35 U.S.C. 154(b) by 196 days.

(21) Appl. No.: 12/712,388

(22) Filed: Feb. 25, 2010

(65) Prior Publication Data

US 2010/0213284 A1 Aug. 26, 2010

(30) Foreign Application Priority Data

Feb. 26, 2009 (DE) ..... 10 2009 010 630

(51) Int. Cl.

| | |
|---|---|
| ***E03C 1/08*** | (2006.01) |
| ***B05B 1/14*** | (2006.01) |
| ***B05B 1/00*** | (2006.01) |
| ***F23D 14/68*** | (2006.01) |

(52) U.S. Cl.

USPC ..... 239/428.5; 239/462; 239/553; 239/590; 239/590.3; 239/590.5; 239/596

(58) Field of Classification Search

USPC ..... 239/428.5, 462, 553, 590, 590.3, 590.5, 239/596, 600

See application file for complete search history.

(56) References Cited

U.S. PATENT DOCUMENTS

| | | | | |
|---|---|---|---|---|
| 3,829,026 | A * | 8/1974 | Aghnides | 239/394 |
| 5,495,985 | A * | 3/1996 | Nehm et al. | 239/428.5 |
| 6,029,912 | A * | 2/2000 | Woolley | 239/428.5 |
| 7,357,337 | B2 * | 4/2008 | Ferrari | 239/428.5 |
| 2006/0102750 | A1 * | 5/2006 | Grether | 239/428.5 |
| 2008/0169361 | A1 * | 7/2008 | Lacher et al. | 239/428.5 |
| 2008/0210777 | A1 * | 9/2008 | Lacher et al. | 239/140 |

* cited by examiner

*Primary Examiner* — Ryan Reis
(74) *Attorney, Agent, or Firm* — Crowell & Moring LLP

(57) ABSTRACT

A jet regulator is provided with a jet fractioning device designed as perforated plate with a number of flow-through holes that are located at a distance to each other. The perforated plate has at least one reinforcement rib on its flat side on the inflow side and/or outflow side to reinforce the perforated plate. On its side facing the outflow side the jet regulator has an additional perforated plate with a number of flow-through holes defined by flow guide walls. At least one distance piece is provided on at least one of the sides of the perforated plate that are facing each other and/or on an adjacent jet regulator component part. The distance piece deforms the perforated plate and the jet regulator component part as the result of a relative motion during the jet regulator installation from a non-deformed initial position into a round bodied or convexly bent application position.

12 Claims, 2 Drawing Sheets

JET REGULATOR

CROSS REFERENCE TO RELATED APPLICATIONS

This application claims priority under 35 U.S.C. §119 to German Patent Application No. 10 2009 010 630.8-25 filed Feb. 26, 2009, the entire disclosure of which is herein expressly incorporated by reference.

BACKGROUND AND SUMMARY OF THE INVENTION

The invention relates to a jet regulator with a jet fractioning device that is designed as a perforated plate having a number of discharge holes that are distant from each other.

The invention also concerns a jet regulator formed by a perforated plate on the discharge side that has a number of flow-through holes defined by flow guide walls, whereby the jet regulator is provided with at least one jet regulator component part that is movable relative to the perforated plate during the jet regulator installation.

The jet regulator of the type mentioned above is already known from diverse embodiments. Such jet regulators are inserted in the drain of a sanitary drain valve, in order to form a homogeneous, non-splashing and perhaps also briskly-soft stream of water. Such jet regulators generally have a jet fractioning device in the interior of their jet regulator housing dividing the inflowing stream of water into many individual jets. The jet fractioning device can be designed as functional units such as jet regulation units or flow straighteners of the jet regulator and can allow mixture of air and water. Thereby, the jet regulator is frequently designed as perforated plate, which can be exposed to large differences in temperature, hot water temperatures, high water pressure on the inflow side of the jet regulator, and can thus be exposed to significant loads. In particular, when the jet regulator is designed as rectangular regulator or as flat jet regulator and its jet regulator housing has a greater longitudinal extension compared to the horizontal extension, the danger exists that the comparably thinly designed perforated plate used as jet regulator deforms under these loads to such an extent that the jet regulator cannot fulfill the intended function, and the inflowing stream of water cannot be formed with an even jet stream.

If the jet regulator is designed as rectangular jet regulator or flat jet regulator, the jet stream generated by the jet regulator is also frequently influenced and the linearly exiting water jet contracts after a short distance into a turbulent and somewhat non-round jet cross section.

Therefore, there is the particular problem of creating a jet regulator of the type mentioned above that distinguishes itself by an even and non-squirting jet stream.

A solution in accordance with the invention involves including at least one reinforcing rib on the flat inflow side and/or outflow side of a perforated plate that is used as jet fractioning device.

On the flat inflow side, the jet regulator in accordance with the invention has in addition to or instead of the perforated plate that serves as jet fractioning device on the flat outflow side, at least one reinforcement rib, which even in the case of a comparably thin-walled or an elongated perforated plate reinforces in such a way that it is well able to withstand the influencing loads. As deformations of a perforated plate that is designed in this way are not to be expected, to that extent, functional disruptions that would otherwise have an unfavorable effect on the jet stream can be precluded as well.

In order to be able to design these reinforcement ribs as thin-walled as possible so that these practically do not represent a flow impediment, it is advantageous to form a grid structure of the reinforcement ribs crossing each other at crossing nodes.

Thereby, a preferred embodiment according to the invention provides that at least the majority of the reinforcement ribs that jointly form a grid structure define polygonal, preferably square and particularly rhombus-shaped grid openings. In particular, such polygonal grid structures can be designed in such a way that the water inflow into the flow-through holes of the perforated plate used as jet fractioning device is not noticeably impeded.

The at least one reinforcement rib practically does not represent a flow impediment when the at least one reinforcement rib is located facing toward or facing away from the inflowing stream of water with its small side of the rib.

It is particularly advantageous when the jet regulator has a multi-part jet regulator housing and when the perforated plate that serves as the jet fractioning device is formed in one piece in a part of the housing that is on the inflow side. A perforated plate that is formed into a housing part in one piece can better withstand the loads acting upon it.

The effort connected with the design and the production of the jet regulator in accordance with the invention can be reduced considerably if the reinforcement ribs are formed in one piece onto the flat side of the inflow or outflow of the perforated plate serving as jet fractioning device.

A particularly advantageous further development in accordance with the invention provides that the reinforcement ribs keep the flow-through holes free, and that the flow-through holes are preferably located axially and/or centrally in a grid opening of the reinforcement ribs that jointly form a grid structure. In this embodiment the inflowing stream of water can be captured in the comparable large grid openings and the quantity of water captured in such can subsequently be pressed through the flow-through hole that is defined by the respective grid opening. In this embodiment the grid openings thus have a concentrating effect on an amount of water respectively at one flow-through hole, and the perforated plate serves as jet fractioning device.

An additional refinement to address the above-identified problem involves that at least one of the sides of the perforated plate that face each other and/or the jet regulator component part, at least one distance piece is provided that deforms the perforated plate by a relative motion of the perforated plate and the jet regulator component part during the jet regulator installation from a non-deformed initial position into a round bodied or convexly bent application position.

A jet regulator designed according to this refinement of the invention has at least one distance piece arranged at least at one of the sides of the perforated disk that are facing each other and/or the jet regulator component part. In the application position of the jet regulator in accordance with the invention, the distance piece works in such a way upon the perforated disk that serves as flow straightener that it is deformed into a round bodied or convexly bent form. While the flow-through holes that are provided in this perforated plate have a longitudinal axis that is approximately parallel to the axis in the non-deformed initial position of the perforated plate, the perforated plate is deformed in such a way in its application position by the distance piece that acts upon the perforated plate that this perforated plate has a round bodied or convexly bent application position. In this round bodied or convexly bent application position, the flow-through holes that are provided in the deformed circumferential edge section of the perforated plate are angled outward with their longitudinal axes in such a way that the water jets exiting the flow-through holes separate, in order to only come together after a comparably long distance in to a potentially non-round overall jet. This ensures that the exiting water jet retains the desired form even over a longer distance.

It is particularly advantageous when the at least one distance piece deforms the perforated plate in such a way that the flow guiding walls that define the flow-through holes of the perforated plate toward the circumference of the perforated plate specify diverging or splayed jet directions of the individual jets guided by the flow-through holes.

A particularly simply designed, but still effective embodiment of the invention provides that the perforated plate and/or the jet regulator component part have a centrally located distance piece. It is also possible that by means of the perforated plate and/or the jet regulator component part, several distance pieces are provided that are distant from each other and have different height, which specify a defined, deformed application position of the perforated plate.

In order to be able to maintain the arrangement of the potentially required functional units at the jet regulator it is advantageous, if the jet regulator component part is designed so that it can be used as a jet regulator housing and preferably as insertion part that is designed as perforated plate.

Other objects, advantages and novel features of the present invention will become apparent from the following detailed description of one or more preferred embodiments when considered in conjunction with the accompanying drawings.

DETAILED DESCRIPTION OF THE DRAWINGS

Figures 1, 2, 3, 4, 5:
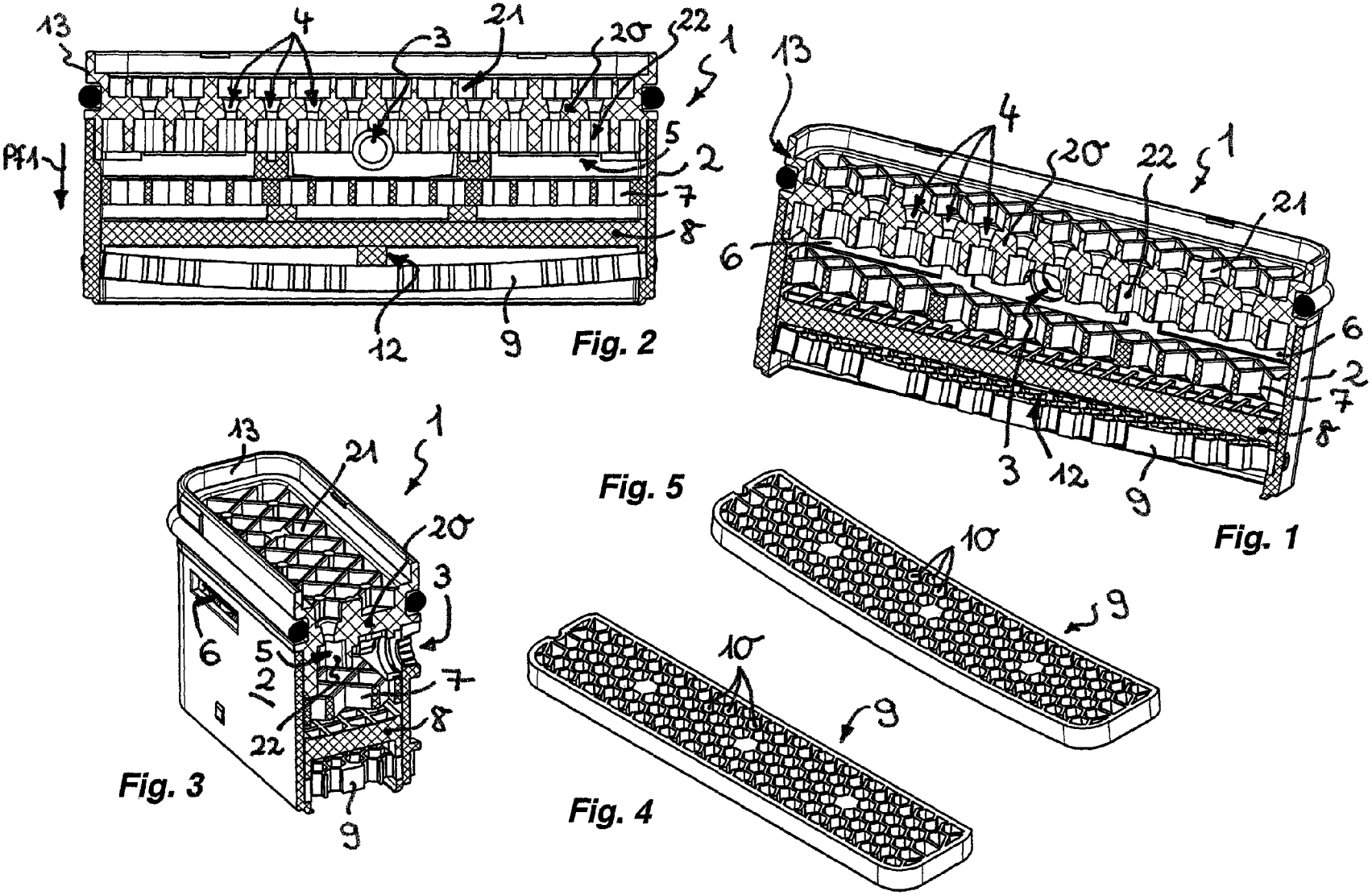
FIG. 1 illustrates a jet regulator designed as a rectangular jet regulator or flat jet regulator illustrated in a longitudinal cross section perspective.
FIG. 2 illustrates the jet regulator of FIG. 1 in a longitudinal cross section.
FIG. 3 illustrates the jet regulator of FIGS. 1 and 2, whereby at the outflow side of the jet regulator, a perforated plate can be recognized that serves as flow straightener, which—as in FIGS. 1 and 2—is also in a deformed application position.
FIG. 4 illustrates the perforated plate serving as flow straightener and designed as separate insertion component in its non-deformed initial position.
FIG. 5 illustrates the perforated plate of FIG. 4 in its deformed application position independent of the other component parts of the jet regulator shown in FIG. 1 to 3.
Figure 6:
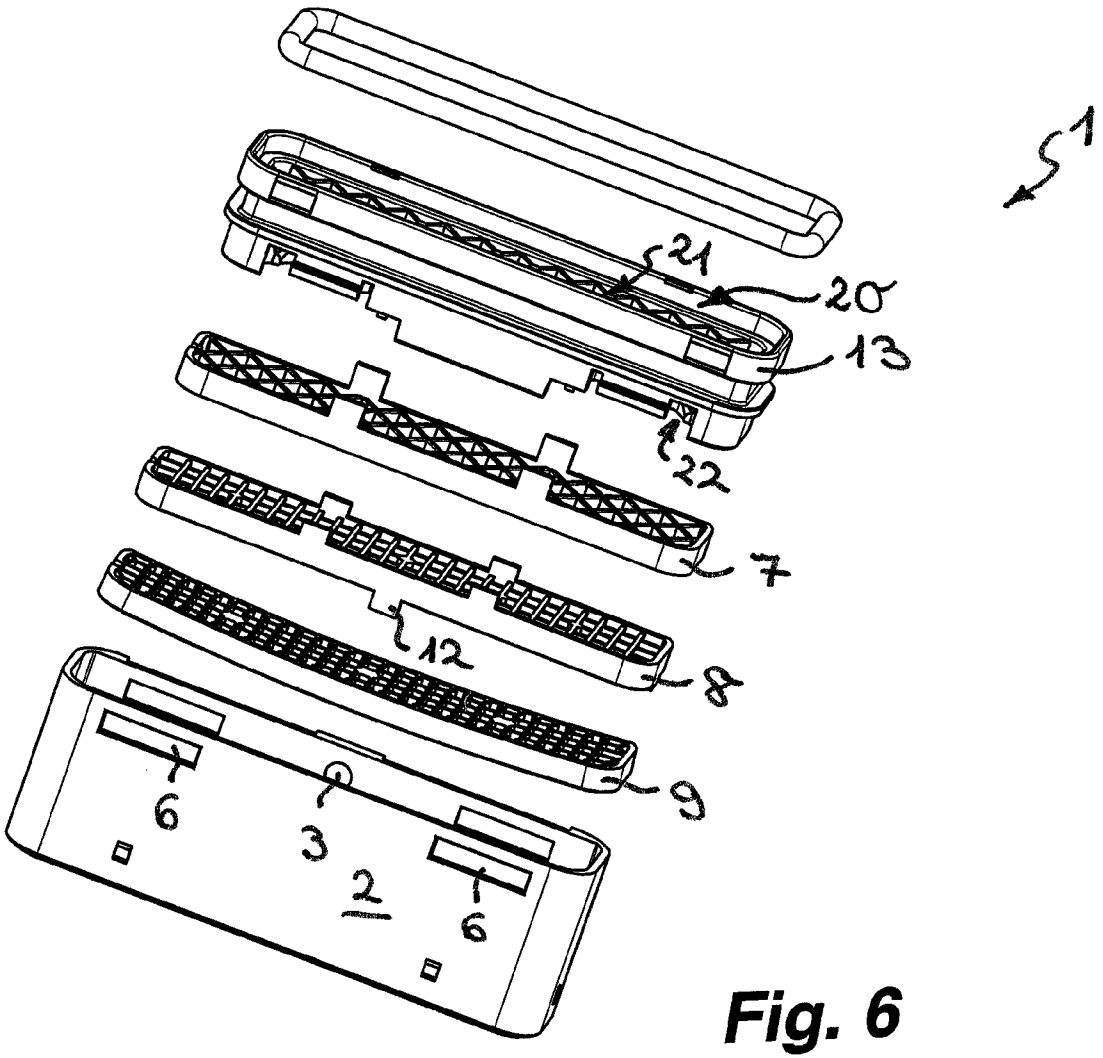
FIG. 6 illustrates the jet regulator from FIG. 1 to 3 in an extended illustration of its component parts and components.

In FIGS. 1 to 3 and 6, a jet regulator 1 is illustrated that is inserted from the facing discharge side into the water discharge of a sanitary drain valve and can be secured there using a stud screw that protrudes through the water drainage up to the fixation opening 3 that is provided at the circumference of the jet regulator housing 2. With the help of the jet regulator 1, which is designed here as ventilated jet regulator, a homogeneous, non-splashing and perhaps also briskly-soft water jet can be formed.

In the interior of its jet regulator housing 2, jet regulator 1 is provided with a jet fractioning device 20 on the inflow side that divides the inflowing stream of water into a number of individual jets. This is achieved by designing the jet fractioning device 20 as perforated plate with a number of flow-through holes 4 that are distant from each other. The individual streams created in at least one section in conically tapered flow-through holes 4 are accelerated in such a way that on the drain side 5 of the jet fractioning device an under pressure is created as a result of which air can be sucked into jet regulator housing 2 from the draining facing side of the drain valve through the at least one ventilation opening 6 on the circumference.

In order to brake the now air-enriched individual jets and to mix the jets with the air that is swept along, in flow direction Pf1 at a distance, below the jet fractioning device 20, a jet regulation unit is provided. The jet regulation unit is formed here by two insertion components 7, 8, which are provided with crossing blades of bars that are parallel to the axis forming a grid structure.

In a flow straightener on the outflow side that is designed as perforated plate 9, the braked individual jets that are well mixed with air are brought together into a homogeneous outflow jet. Thereby, the perforated plate 9 serving as flow straightener is provided with a honeycomb structure with flow-through holes defined by flow guide walls 10, which are in cross section square and in particular hexangular flow-through holes.

In the enlarged illustration of FIGS. 1 to 3, it can be seen that the perforated plate that serves as jet fractioning device 20, which, as a consequence of the large temperature differences, the hot water temperatures and the high water pressures can also be exposed to significant loads, is comparably designed with thin walls in spite of its longitudinal extension.

So that the perforated plate 20 can withstand these significant loads and does not deform in such a way that the jet regulator 1 can no longer ensure its jet-forming function, the perforated plate 20 has reinforcing reinforcement ribs 21, 22 on its flat inflow side and on its flat outflow side. These reinforcement ribs 21, 22 are formed in one piece onto the flat sides of the perforated plate 20, the reinforcement ribs 21, 22 cross each other at crossing nodes to form a grid structure with polygonal, preferably square and here, in particular rhombus-shaped grid openings. The reinforcement ribs 21, 22 are facing or are facing away from the inflowing stream of water flowing in the direction of arrow Pf1 with the small side of their ribs in such a way that they form as little flow resistance as possible.

In FIGS. 1 to 3 it can be recognized that the reinforcement ribs 21 provided on the flat side of the inflow side keep the flow-through holes 4 free and that the flow-through holes 4 are provided approximately axially or centrally in respectively a grid opening of the reinforcement ribs 21. In the grid openings of the grid structure formed by the reinforcement ribs 21, a comparably large amount of fluid can thus be captured and subsequently be pressed through the flow-through holes 4 (which are smaller compared to the grid opening), which additionally optimizes the function of the perforated plate that serves as jet fractioning device 2.

By comparing FIGS. 1 to 3 and 6 it becomes clear that the perforated plate 9 serving as flow straightener is movable during installation of the jet regulator 1 relative to the component parts 7, 8 of the jet regulator 1 that are located upstream in the direction of flow. Thereby, on the flat side that is facing the perforated plate 9 of the jet regulator component part 8, a rib or bar-shaped distance piece 12 is provided in the longitudinal direction of the insertion component 8, approximately axially and extending over the horizontal cross section of the insertion component 8, which deforms the perforated plate by a relative motion of perforated plate 9 and jet regulator component part 8 during the jet regulator installation from a non-deformed initial position into a round bodied or convexly bent application position.

While the non-deformed initial position of the perforated plate 9 is illustrated for better understanding in FIG. 4, the round bodied or convexly formed application position is shown in FIGS. 1, 2, 5 and 6. As the flow-through holes provided in perforated plate 9 in the initial position shown in FIG. 4 have longitudinal axes approximately parallel to the axis, the perforated plate that is produced as extrusion part can be easily removed from the extrusion tool. As the perforated plate 9 is, however, formed convex or round bodied in its application position, the flow guide walls 10 that define the flow-through holes of the perforated plate 9 are splayed toward the perforated plate's circumference in such a way that they specify diverging jet directions toward the outside of the individual jets guided in the flow-through holes. The perforated plate 9 thus favors a splayed linear jet cross section of the exiting water jet, which can thus retain its linear jet form over a comparable long distance and only after a comparably long distance pulls together into a perhaps also non-round jet cross section.

As is clear by comparing FIGS. 1 and 2, the jet regulator component parts upstream of the perforated plate 9 in the direction of flow Pf1 are supported against each other so that the perforated plate 9 is deformed by distance piece 12, that the perforated plate serving as jet fractioning device 20 is reinforced by the reinforcement ribs 21, 22.

It is clear in FIGS. 1 to 6 that the jet regulator 1 is designed here as rectangular jet regulator or flat jet regulator, that has a non-round jet exit, which has a larger longitudinal extension compared to the horizontal extension.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A jet regulator, comprising:

a jet fractioning device that is a perforated plate with walls forming a number of flow-through holes that are at a distance to each other, wherein at least some of the number of flow-through holes have a portion with a cylindrical or conically tapering cross-section in a flow direction of the jet regulator; and a plurality of reinforcement ribs that reinforce the perforated plate on a flat side of an upstream side and/or on a downstream side of the perforated plate, wherein the plurality of reinforcement ribs are located facing or facing away from the inflow side with a small side of their ribs, and wherein in an area where the plurality of reinforcement ribs abut the walls forming the number of flow-through holes, the plurality of reinforcement ribs have a different sized cross-section in the flow direction than the at least some of the number of flow-through holes.

2. The jet regulator according to claim 1, wherein the reinforcement ribs that cross each other at crossing nodes to form a grid structure.

3. The jet regulator according to claim 2, wherein at least a majority of the plurality of reinforcement ribs that jointly form the grid structure define polygonal openings.

4. The jet regulator according to claim 3, wherein the polygonal openings are square.

5. The jet regulator according to claim 4, wherein the square polygonal openings are rhombus-shaped.

6. The jet regulator according to claim 1, further comprising:

a multi-part jet regulator housing that is molded in one piece onto a housing part on the inflow side of the perforated plate.

7. The jet regulator according to claim 2, wherein the plurality of reinforcement ribs are molded in one piece onto the flat side on the inflow side and/or the outflow side of the perforated plate.

8. The jet regulator according to claim 2, wherein the plurality of reinforcement ribs keep the flow-through holes free and the flow-through holes are located axially or centrally in respectively one grid opening of the reinforcement ribs that form the grid structure.

9. The jet regulator according to claim 1, wherein the jet regulator is a rectangular jet regulator, a flat jet regulator or has a non-round jet exit, which has a larger longitudinal extension compared to the horizontal extension.

10. A jet regulator, comprising:

a perforated plate forming a facing side on a downstream side of the jet regulator, wherein the perforated plate has flow-through holes defined by flow guide walls;

at least one jet regulator component part that is movable relative to the perforated plate during the jet regulator assembly, wherein at least one distance piece is arranged on the perforated plate or the jet regulator component part, and wherein during the assembly of the jet regulator the at least one distance piece deforms the perforated plate from a non-deformed initial position into a round bodied or convexly bent application position as a result of a relative motion of the perforated plate and the at least one jet regulator component part, wherein the at least one distance piece deforms the perforated plate in such a way that the flow guide walls defining the flow-through holes of the perforated plate specify diverging or splayed jet directions in the direction of the perforated plate's circumference for the individual jets guided in the flow-through holes, wherein, in a flow direction, the perforated plate is a last component of the jet regulator so that liquid exits the jet regulator in diverging or splayed directions.

11. The jet regulator according to claim 10, wherein the at least one distance piece of the perforated plate or the jet regulator component part is centrally located.

12. The jet regulator according to claim 10, wherein the jet regulator component part is arranged so that it can be inserted into a housing of the jet regulator.

* * * * *